US006338257B1

(12) United States Patent
Chiu et al.

(10) Patent No.: US 6,338,257 B1
(45) Date of Patent: Jan. 15, 2002

(54) SEPARATED TYPE AIR CONDITIONER WITH EVAPORATIVE CONDENSING APPARATUS

(75) Inventors: Peng Chu Chiu, Hsinchu; Chih Hsien Huang, Hsinchu Hsien, both of (TW)

(73) Assignee: Nutec Electrical Engineering Co., Ltd., Taipei (TW)

( * ) Notice: Subject to any disclaimer, the term of this patent is extended or adjusted under 35 U.S.C. 154(b) by 0 days.

(21) Appl. No.: 09/727,478

(22) Filed: Dec. 4, 2000

(30) Foreign Application Priority Data

Aug. 2, 2000 (TW) ..... 89115539

(51) Int. Cl.[7] ..... F28D 5/00
(52) U.S. Cl. ..... 62/305; 62/171
(58) Field of Search ..... 62/305, 171

(56) References Cited

U.S. PATENT DOCUMENTS

| | | | | | |
|---|---|---|---|---|---|
| 4,968,457 | A | * | 11/1990 | Welch | 261/39.1 |
| 5,106,543 | A | * | 4/1992 | Dodds | 261/36.1 |
| 5,117,644 | A | * | 6/1992 | Fought | 62/171 |
| 5,390,502 | A | * | 2/1995 | Storbeck et al. | 62/91 |
| 5,401,419 | A | * | 3/1995 | Kocib | 210/697 |
| 5,411,078 | A | * | 5/1995 | Ares | 165/113 |
| 5,444,991 | A | * | 8/1995 | Cox | 62/305 |
| 5,605,052 | A | * | 2/1997 | Middleton et al. | 62/171 |
| 5,957,771 | A | * | 9/1999 | Back | 454/233 |
| 6,101,823 | A | * | 8/2000 | Chiu et al. | 62/171 |

* cited by examiner

*Primary Examiner*—William Doerrler
*Assistant Examiner*—Mark Shulman
(74) *Attorney, Agent, or Firm*—Rosenberg, Klein & Lee

(57) ABSTRACT

A separated type air conditioner with evaporative condensing apparatus comprises an outdoor unit and at least one indoor unit which the outdoor unit includes an evaporative condensing apparatus, a water chiller type evaporating apparatus and a comparative low pressure compressor for circulating a cooling medium system between the condensing apparatus and the evaporating apparatus within the outdoor unit to avoid long distance medium transmitting for improving the energy saving and environment protecting, and characteristically that the evaporative condensing apparatus comprises an evaporative water intermittent supply system to supply water onto a layer of absorptive material covered on the condensing coils intermittly through an electromagnetic valve automatically controlled by a PC board to assume that the amount of water once supplied to the absorptive material will be approximately fully evaporated within a controlled intermittence to provide a highest effect for absorbing evaporative latent heat form the gas state medium in the condensing coils so as to obtain an extreme low temperature that the medium can be condensed by a low relative critical pressure in using a comparative low power medium compressor for saving a large amount of energy therefore, while each indoor unit is respectively formed of a chilled water/air heat exchanger for cooling the air currents to an ideal condition by the chilled water delivered from the outdoor unit through a water circulating piping system.

9 Claims, 22 Drawing Sheets

SEPARATED TYPE AIR CONDITIONER WITH EVAPORATIVE CONDENSING APPARATUS

FIELD OF THE INVENTION

The present invention relates to a separated type air conditioner having an outdoor unit connected to at least one indoor unit by a chilled water circulating system, and more particularly relates to such a separated type air conditioner in which an evaporative condensing apparatus is used in the outdoor unit to greatly improve the cooling efficiency therefore.

BACKGROUND OF THE INVENTION

In a conventional separated type air conditioner, a condenser and an evaporator of a cooling medium system are separately installed in an outdoor unit and an indoor unit, therefore a long distance piping system of cooling medium is needed between the outdoor unit and the indoor unit for cooling medium circulating. However, there will be several disadvantages occurred, a large amount of cooling capability wasted in the long distance medium pipe due to that the medium is performed of low special heat and the pipes are exposed in the open air of a hot environment, further, the longer pipe of cooling medium is used, the higher compressing pressure of the medium compressor is needed, the power consumption then will be highly increased, further more, a long distance piping of cooling medium exposed in open air has the weakness of leakage due to a weather changing or an accident, it will seriously pollutes the environment.

Theoretically, during the condensing process of cooling medium in the condensing apparatus, the medium is liquidized due to a temperature dropping by a cooling system under a certain high pressure delivered by a compressor, in which, the lower temperature can be reached, the lower relative critical pressure is needed and then a low pressure compressor can be employed for energy saving. FIG. 15 shows a liquid-gas curve obtained form R-22 cooling medium. As indicated the cooling medium can easily be condensed with a low relative pressure when at a low temperature, for example: when at 45° C. as point C of the curve, which is almost a lowest temperature that a conventional condensing unit can reach to, in which the relative critical pressure needed for condensing is about 18 kg/cm$^2$, if the temperature can be dropped to 30° C. as point B, by a high efficient cooling system the relative critical pressure needed for condensing will be drastically reduced to 12.27 kg/cm$^2$. Therefore, the energy efficiency ratio (E.E.R.) of an air conditioner is directly proportion to the efficiency of the cooling system used in the condensing unit.

An evaporative type condensing apparatus of an air conditioner dissipates heat by means of evaporation of water which is sprayed on to the surface of the medium coil. Theoretically one liter of water absorbs about 539 Kcal evaporating latent heat when evaporated. Therefore the heat dissipation effect of an evaporative type is much better than an air cooling type or a water cooling type. However, when a conventional evaporative type condenser is used, it still has two disadvantages, firstly, the spraying water can not be held on a smooth surface of the bare metal condensing coils for a enough period of time to let the water getting fully evaporated, it will flows off from the medium coils before evaporated,therefore the heat dissipation effect is not fully developed, it can't do much better than the other two types; secondary, a large water storage means is needed to collect waste water that is not evaporated at the evaporative condensing unit of the air conditioner.

SUMMARY OF THE INVENTION

The present invention has been accomplished to provide a separated type air conditioner which eliminates the aforesaid drawbacks.

It is a main object to provide a separated type air conditioner in which the cooling medium system is circulated within the outdoor unit only, and not circulated to indoor unit ,instead, a chilled water circulating system is used to connect from outdoor unit to each of indoor unit for cooling capability transmitting so as to improve the energy saving and environment protecting.

It is another object to provide a separated type air conditioner which an evaporative condensing apparatus is used in the outdoor unit for highly increasing the cooling efficiency to provide an extreme low temperature of the cooling medium there at, in which the relative critical pressure needed to condense the gas state cooling medium into liquid state can be greatly reduced, therefore a comparative low pressure compressor of low power consumption can be employed for energy saving.

According to one expect of the present invention which the evaporating apparatus in the outdoor unit is formed of a medium/water heat exchanger type water chiller in which the cooling medium absorbs heat from water during evaporating so as to produce chilled water thereat; the indoor unit is formed of a water/air heat exchanger type air cooler comprising a plurality of chilled water coils having a plurality of parallel cooling fins perpendicularly to the coil tubes to form a plurality of air gaps there between, a fan system disposed at a front side of the chilled water coils for delivering a current of air passing through the air gaps between the cooling fins and to be cooled therefore; and a water circulating system comprising a water pump disposed in the outdoor unit for operating the system therefore, a piping system including a chilled water delivering piping connected form an outlet pipe fitting of the water chiller of the outdoor unit to an inlet pipe fitting of the air cooler of the indoor unit, and a water feedback piping connected from an outlet pipe fitting of an inlet pipe fitting of the water chiller of outdoor unit.

According to another one aspect of the present invention, the evaporative condensing apparatus of the outdoor unit comprises a plurality of condenser coils and characteristically having a layer of absorptive material covered on the condenser coils, a water supply system having a plurality of water spray tubes and absorptive material covered on the water outlets of the water spray tubes for permitting supplied evaporative water to be evenly smoothly distributed to the absorptive material at the condenser coils, and a control PC board which automatically adjusts an intermittent period of water supplying according to a temperature signal taken from the condensing coil by a thermal sensor, and an electromagnetic valve controlled by the control PC board to let water be delivered intermittently from a water source to the layer of absorptive material of each condenser coil; a compressor of comparative low pressure controlled to provide an adequate pressure for delivering the gas state cooling medium into the condensing unit and to condense the medium into liquid state thereat. And a condenser fan controlled to draw currents of air through gaps in the condenser coils of the evaporative condensing unit in carrying the evaporated moisture and heat away from the evaporative condensing unit.

DETAILED DESCRIPTION OF THE PREFERRED EMBODIMENT

Figure 1:
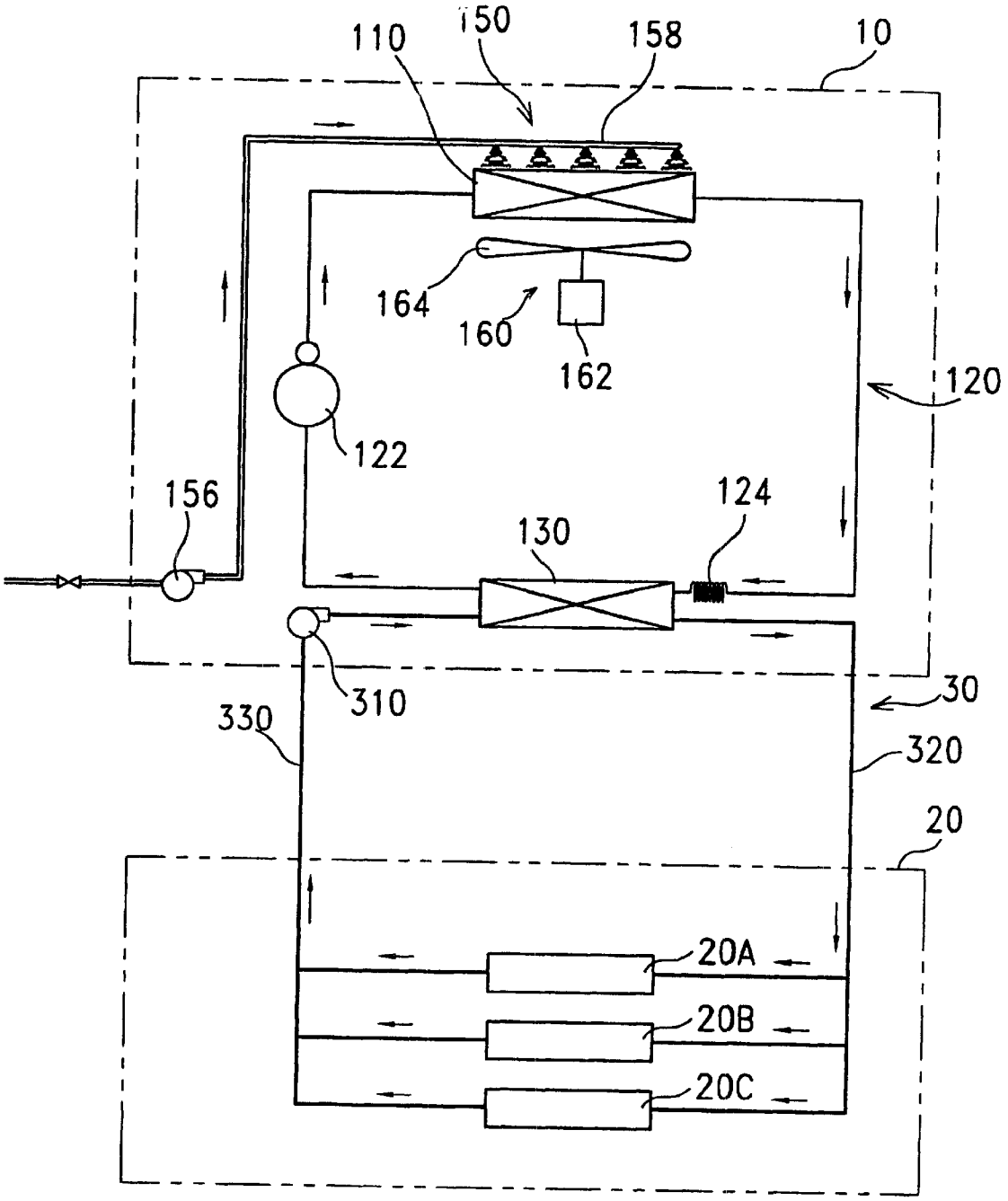
FIG. 1 is a schematic plane view according to the present invention.
Figure 2:
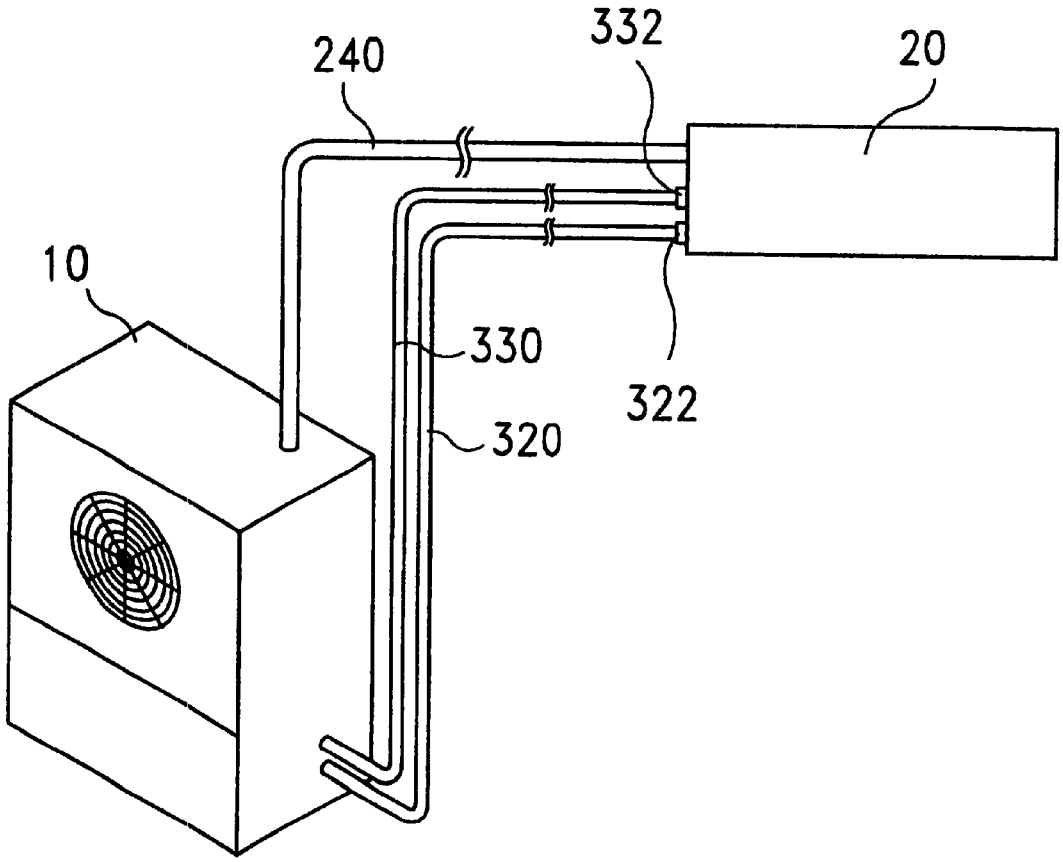
FIG. 2 is a perspective view of an embodiment of a separated type air conditioner according to the present invention of FIG. 1. (Shown one indoor unit only.)

Please referring to FIGS. 1 and 2, a separated type air conditioner according to the present invention comprises an outdoor unit 10 and at last on indoor unit 20 (20A, 20B and 20C as shown in FIG. 1), and a chilled water circulating system 30 connected between the outdoor unit 10 and the indoor unit 20 for cooling capability transmitting.

Which the outdoor unit 10 comprises an evaporative condensing apparatus 110 including an evaporative water supply system 150 having a water distributor 158 and an electromagnetic valve 159 for intermittently supplying water therefore, and a fan system 160 having a motor 162 and a fan blade 164 to draw currents of air for speeding the evaporative water to be evaporated and carrying the evaporated moisture and heat away from the condensing unit 110; an evaporating apparatus 130 formed of a medium/water heat exchanger type water chiller to chill a circulating flow of water thereat; and a cooling medium system 120 having a compressor 122 to compress the gas state cooling medium into the evaporative condensing apparatus 110 in a proper critical pressure for condensing the gas state medium into liquid state and circulating the liquid state medium to the medium/water heat exchanger type evaporating apparatus 130 through an expansion valve 124, in which the medium absorbing a large amount of heat from the circulating water due to evaporating, the evaporated gas state medium is then guided into the compressor 122 to complete a circulation of medium system therefore.

While each indoor unit 20 is formed of a water/air heat exchanger having a fan system (not shown) for circulating an air flow to be cooled by chilled water therefore.

And a chilled water circulating system 30 including a water pump 310 disposed at a front of an inlet 136 of the water chiller type evaporating apparatus 130 of the outdoor unit 10 for pumping water into the water chiller type evaporative apparatus 130, a chilled water delivering piping 320 connected from an outlet 138 of the water chiller type evaporative apparatus 130 to an inlet pipe fitting 322 of the indoor unit 20, and a water feedback piping 330 connected from an outlet pipe fitting 332 (FIG. 14) of the indoor unit 20 back to the pump 310 so as to complete the circulation of the system 30 therefore.

Figure 3:
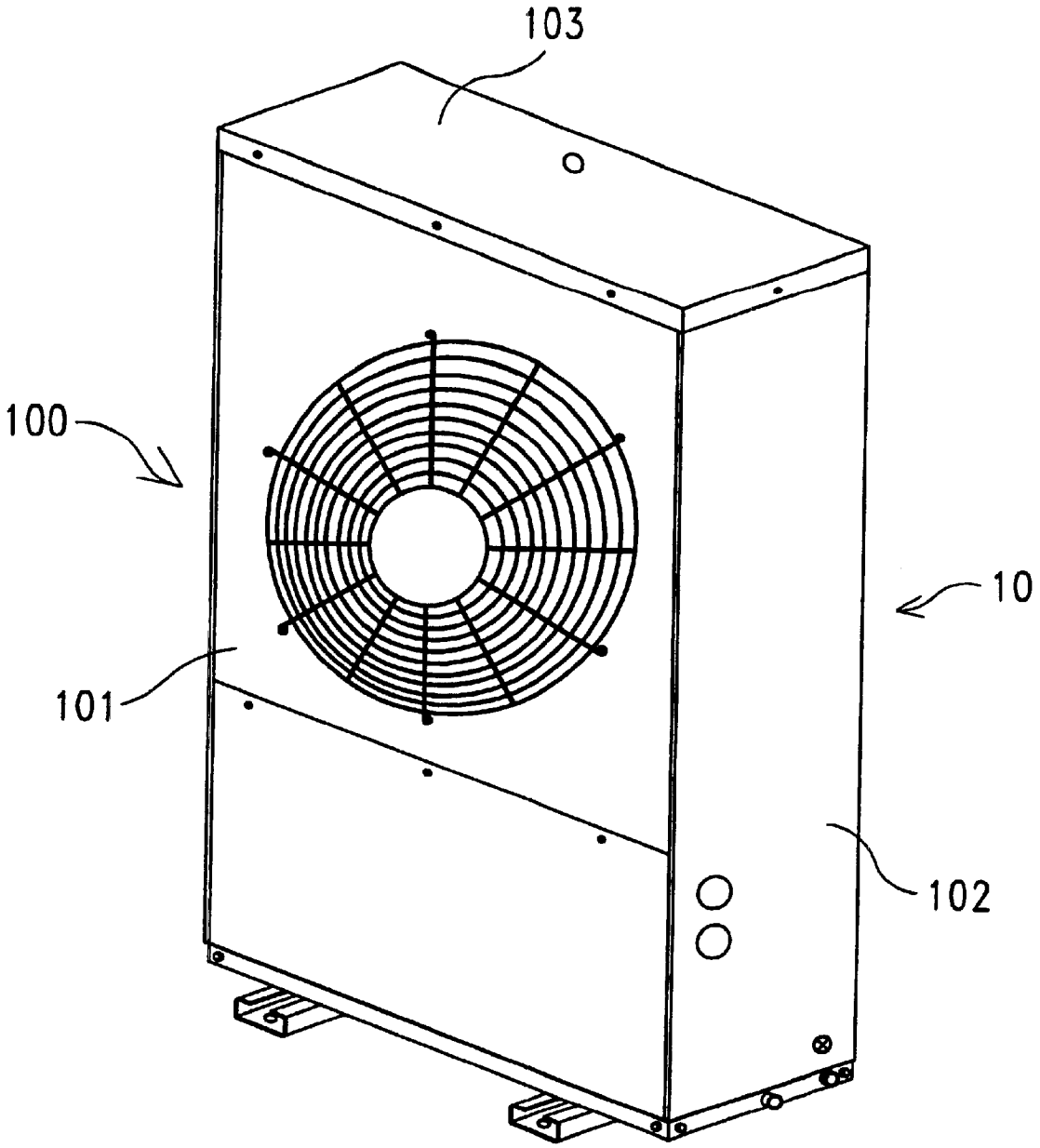
FIG. 3 is a perspective view of an outdoor unit according to a preferable embodiment of the present invention.
Figure 4:
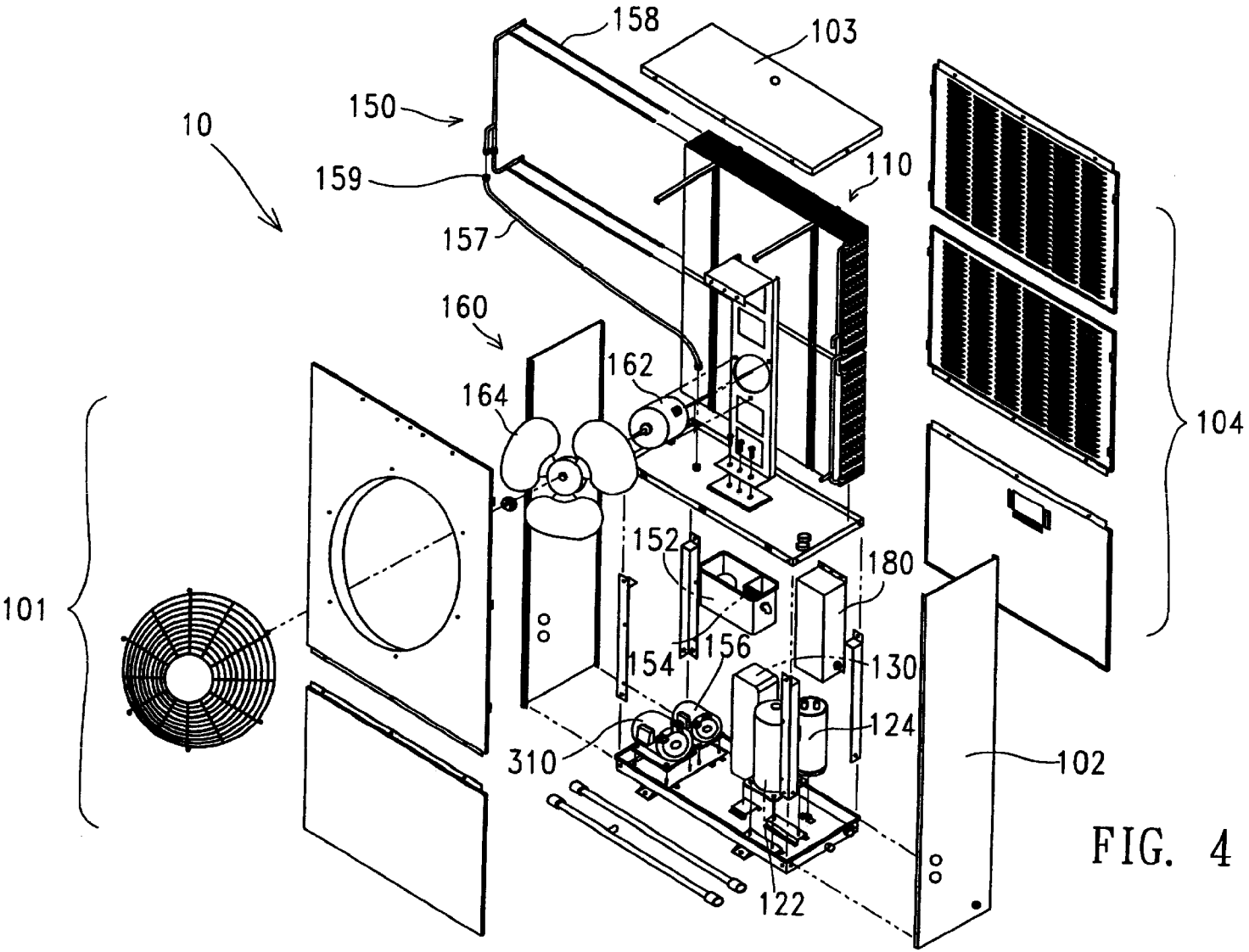
FIG. 4 is an exploded view of FIG. 3.
Figure 5:
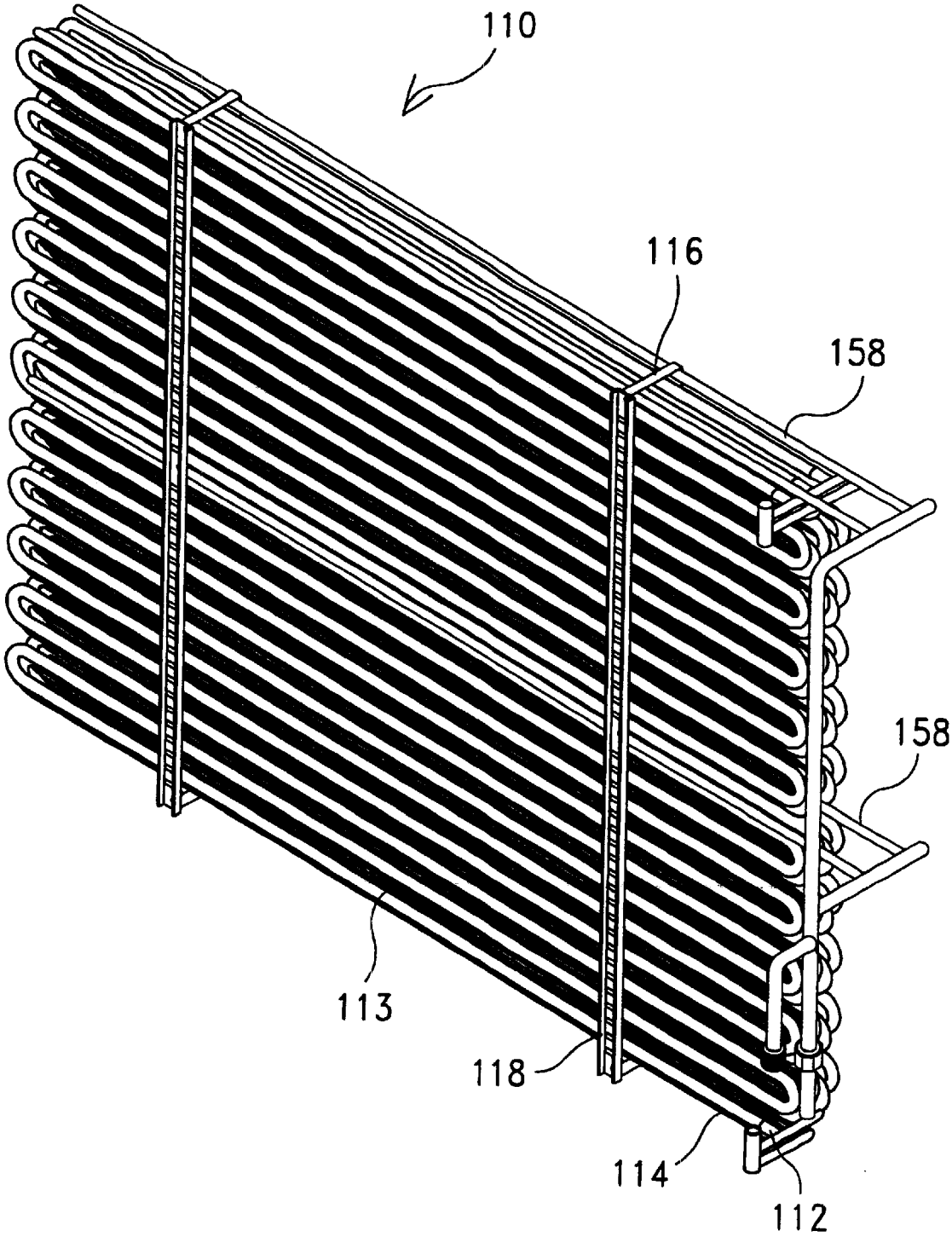
FIG. 5 shows a preferable embodiment of an evaporative condensing apparatus of the present invention.

Referring to FIG. 3 and 4, the outdoor unit 10 comprises: A casing 100 having a front panel 101 with a fan screen, a U-type flange 102, a top cover 103, and a back panel 104 with a plurality of air slats; An evaporative condensing apparatus 110 (referring with FIG. 5 and FIG. 6) including a plurality of condensing coils 112 respectively covered with a layer of absorptive materials 114 and fastened to a plurality of supporting racks 116 and fastening numbers 118 to fasten the condensing coils 112 to a flat rectangular pack and formed a plurality of air gaps 113 between the coils 112; An evaporative water supply system 150 which mainly takes water source directly from the city water system to a plurality of water distributors 158 through a tube 157 and an electromagnetic valve 159 for intermittently supplying water to the layer of absorptive material 114, a stand by water source used in case of when the city water system is accidentally stopt including a water tank 152, a screen 154 and a pump 156, in which the condensed water occurred on the outside surface of the water chiller 130 will be collected to the water tank 152 and the condensed water occurred on the outside surface of the chilled water coils of each indoor unit 20 will be also collected and respectively guided by a tube 240 (see FIG. 2) to the tank 152 of the outdoor unit 10.

Figure 5A:
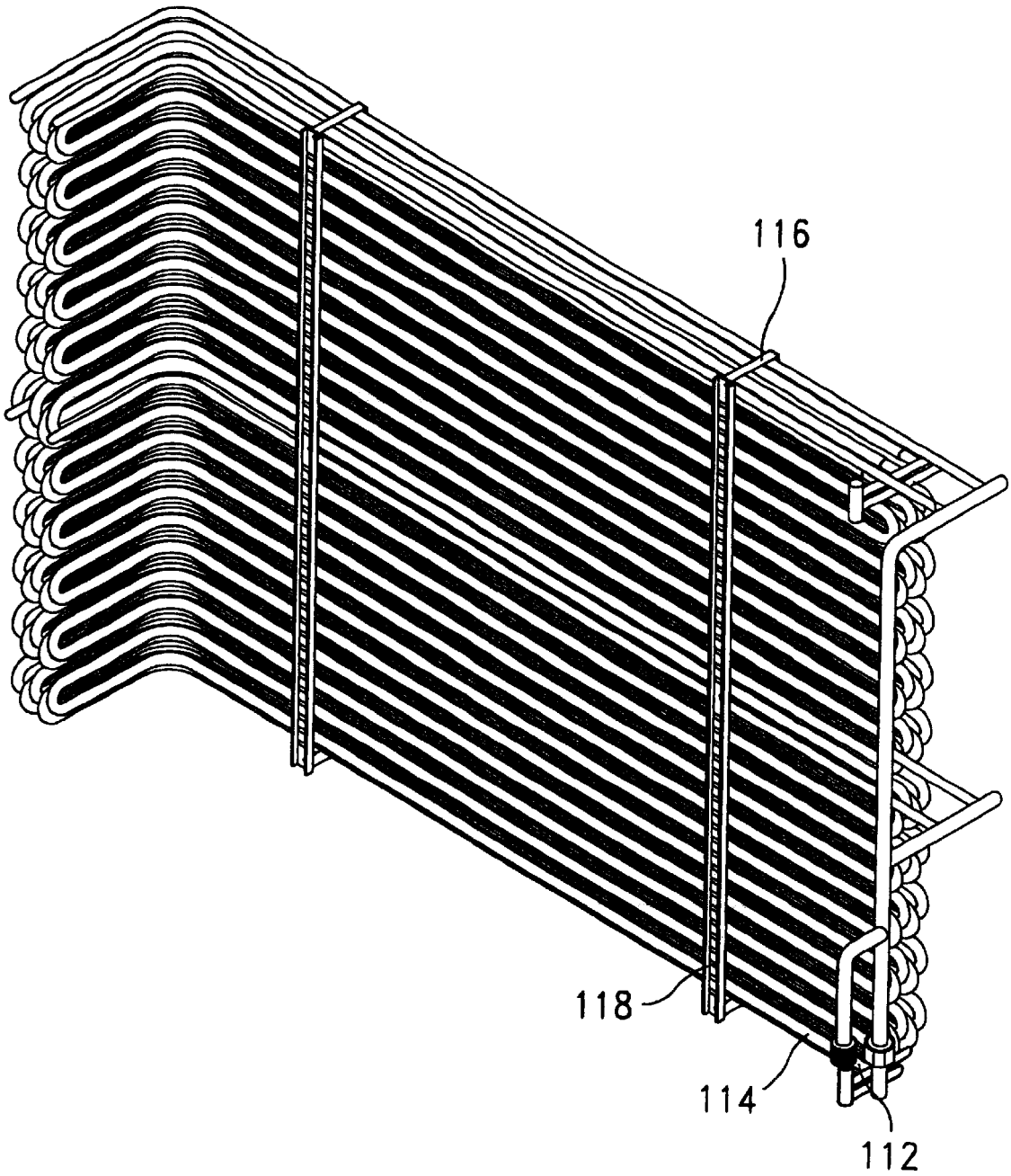
FIG. 5A is another embodiment of an evaporative condensing apparatus of the present invention.

A fan system 160 including a motor 162 and a fan blade 164 to blow a current of air flow through the gaps 113 for speeding the evaporating of the evaporative water in the absorptive material 114 and carrying the evaporated moisture and heat away from the evaporative condensing apparatus 110, in which a large amount of evaporative latent heat absorbed from the cooling medium in the coil 112 causes the temperature of the medium reached to a much lower point than that the other conventional types of condensing apparatus can be reached, therefore a comparatively lower relative critical pressure can sufficiently be used to condense the medium thereat; An evaporating apparatus 130 which is a heat exchanger type water chiller disposed on a base plate of the U-type flange 102 of the casing 100 for producing chilled water thereat; A cooling medium circulating system 120 including a medium compressor 122 to provide a comparative low pressure which is just satisfied to a relative critical point for condensing the medium of comparative low temperature in the evaporative condensing apparatus 110 so as to save a large amount of energy therefore, the condensed liquid state medium is then guided to the evaporating apparatus 130 through an expansion valve 124 to make a heat exchange with water during the medium evaporating, then the evaporated gas state medium will be guided into the compressor 122 to complete a circulation of the system therefore;

Referring to FIG. 5A which shows another embodiment of the evaporative condenser 110 having a plurality of "L"-shaped condensing coils 112 covered with a layer of absorptive material 114 for increasing the area of heat conducting surface and absorptive material to improve the cooling efficiency therefore.

Figure 5B:
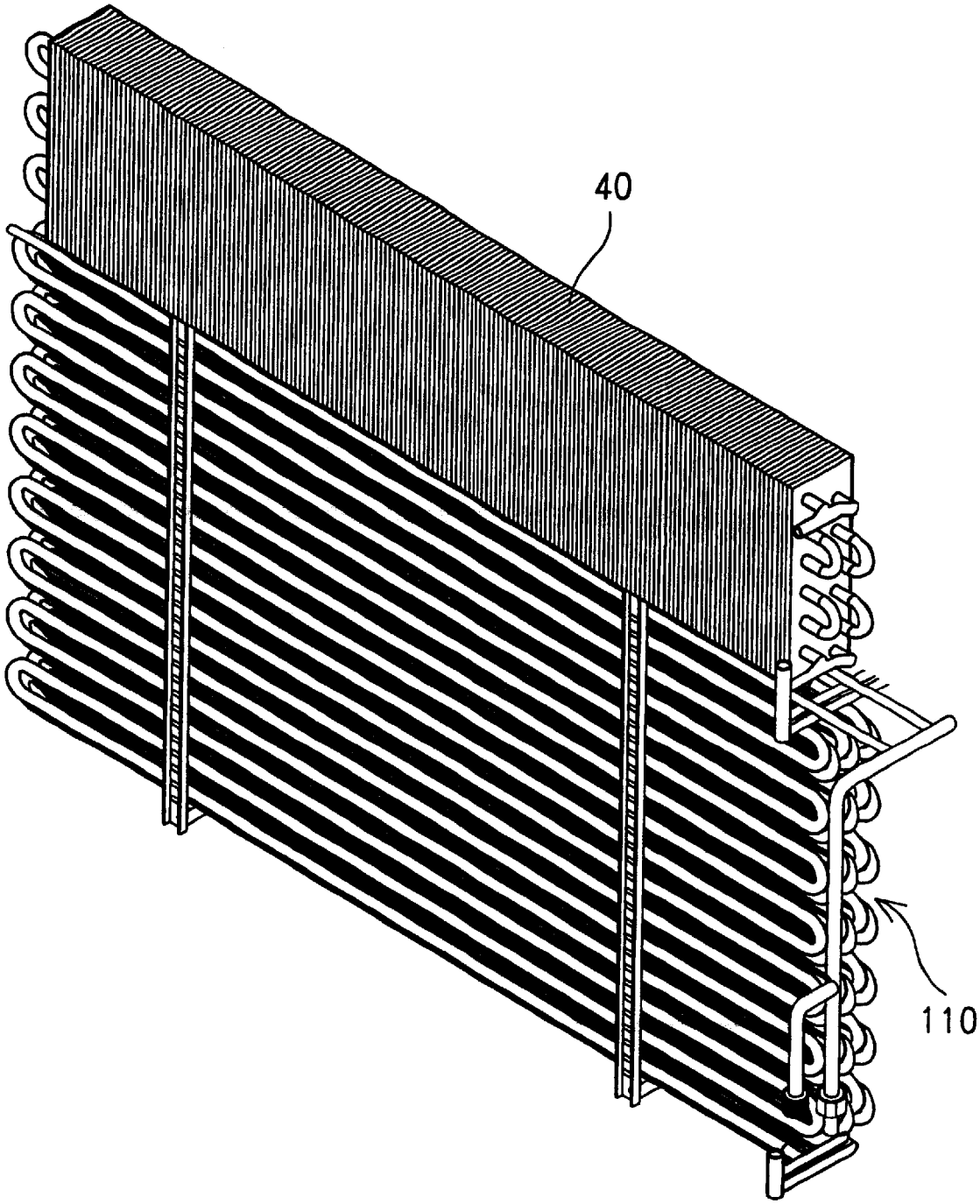
FIG. 5B shows a partial evaporative condensing apparatus according to the present invention which is combined with a conventional air cooled condenser.
Figure 5C:
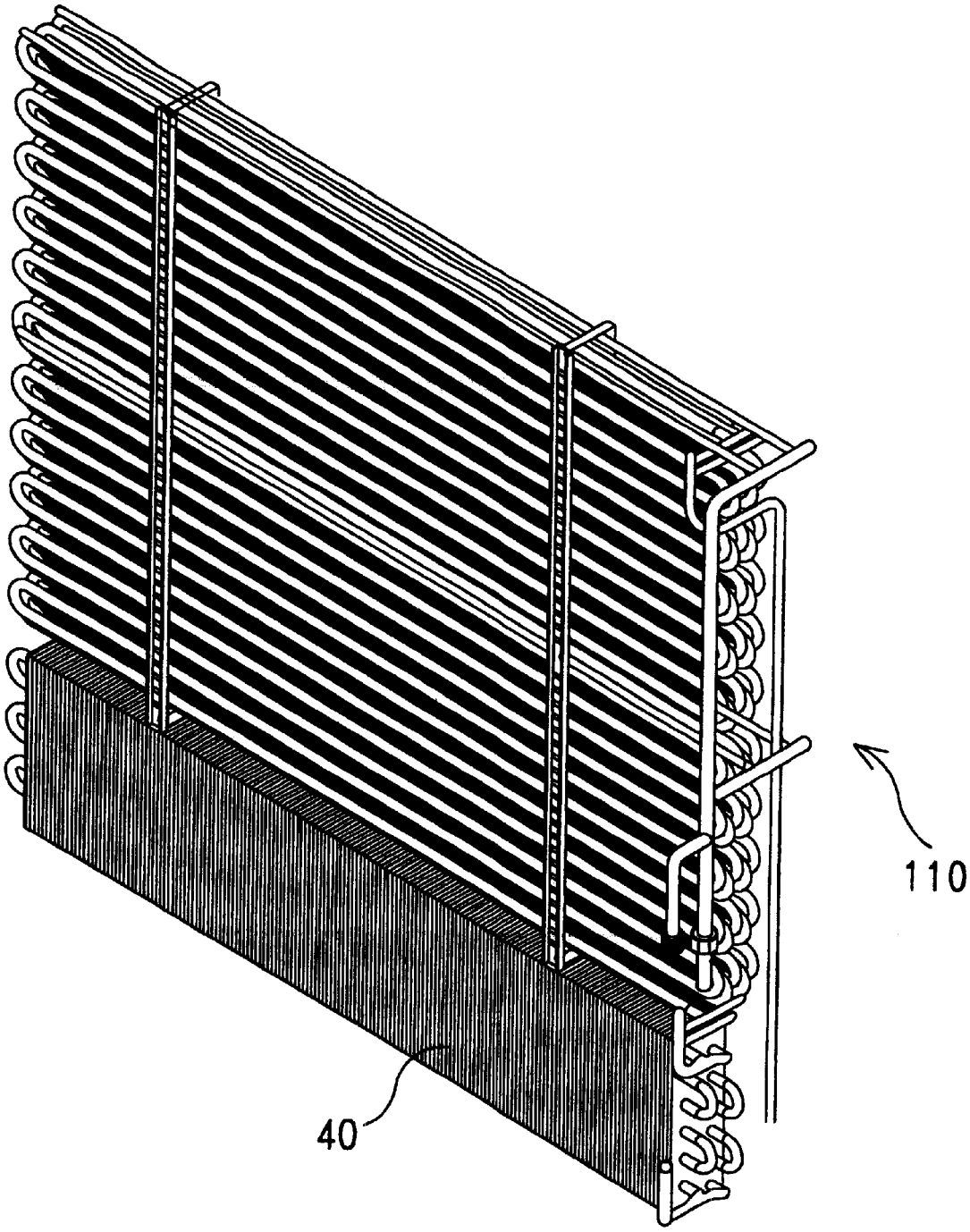
FIG. 5C and 5D show a second and a third embodiment of a partial evaporative condensing apparatus.
Figure 5D:
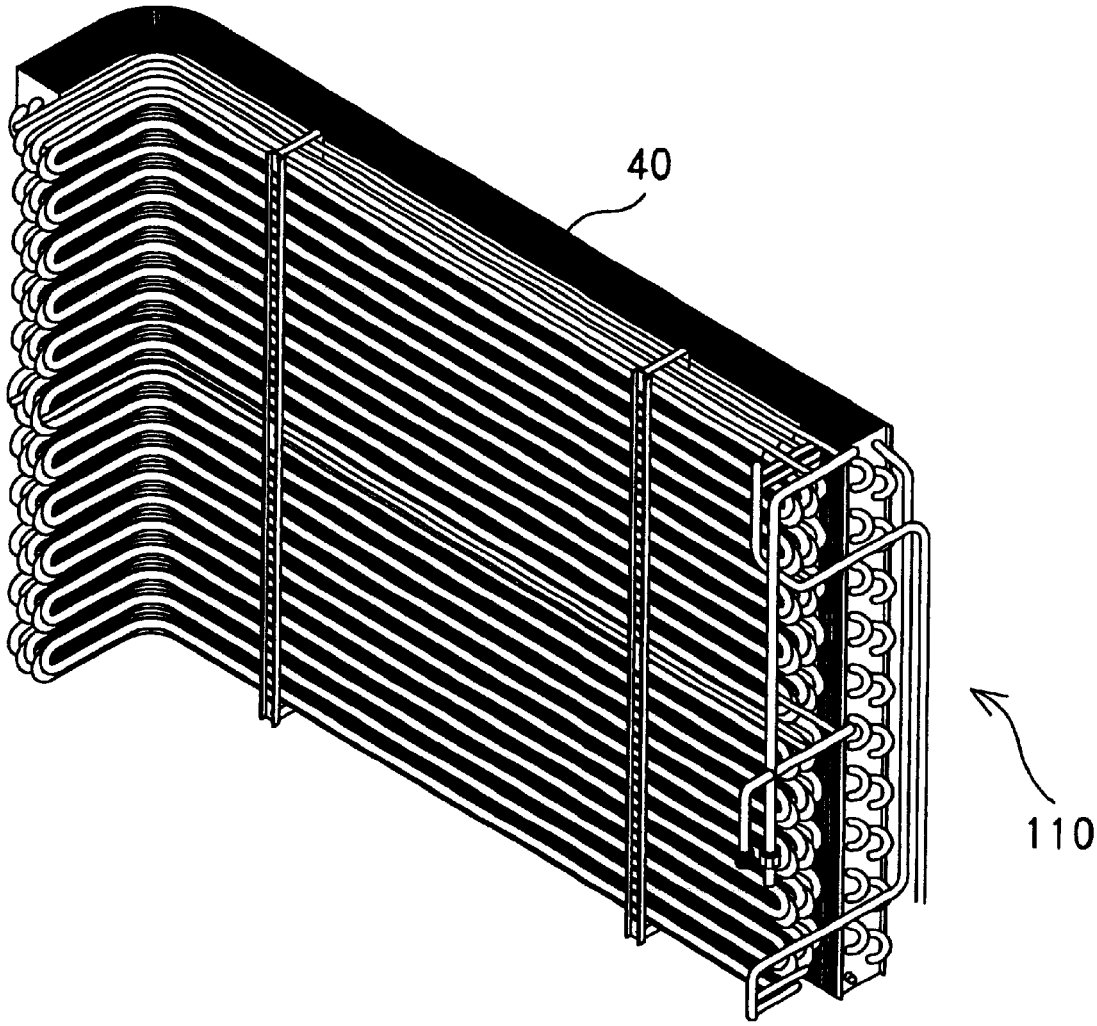

Referring to FIG. 5B, 5C and 5D, which an evaporative condensing apparatus 110 can be used to combine with a conventional air cooled condenser 40 in different types if necessary.

Figure 6:
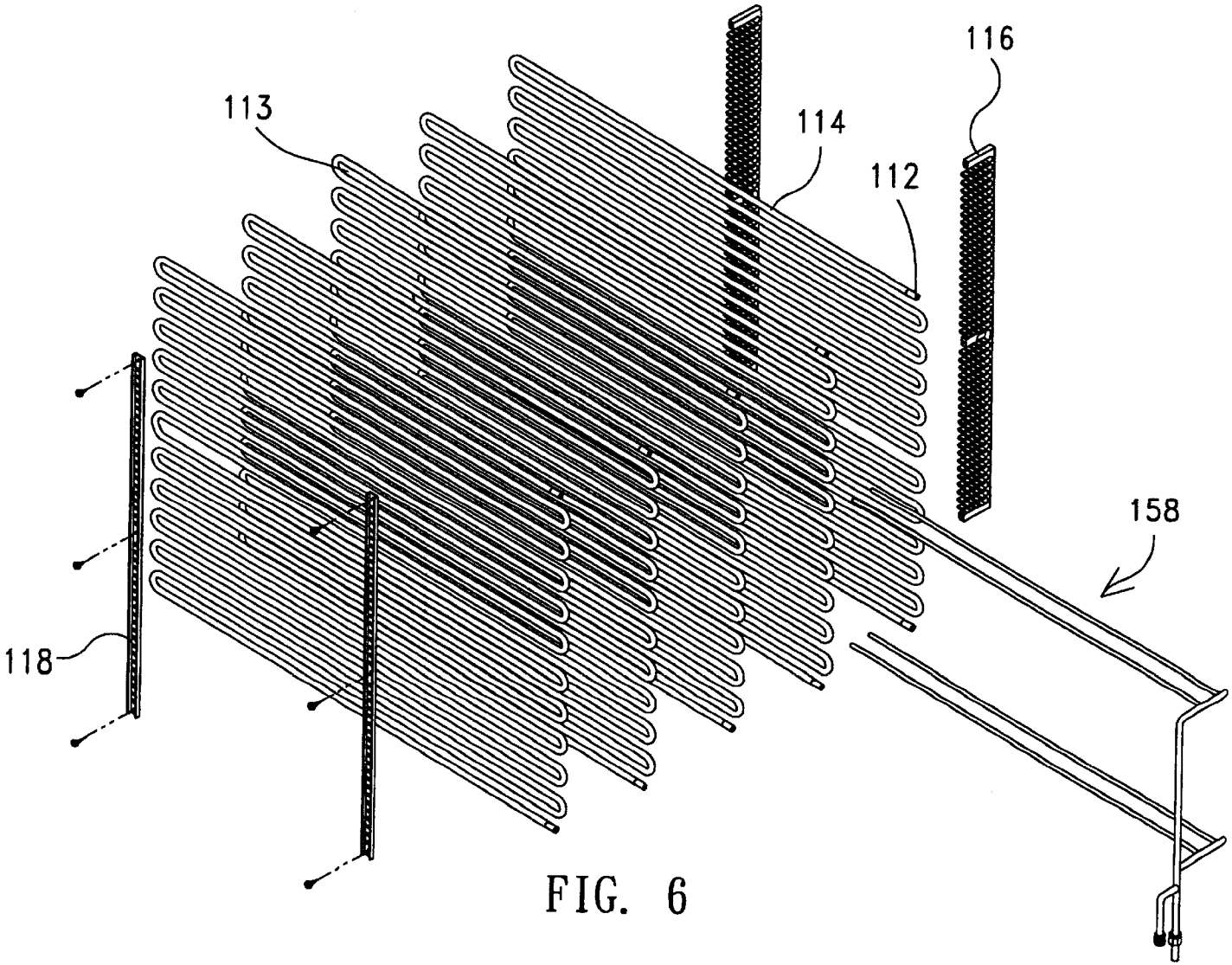
FIG. 6 is an exploded view of an evaporative condensing apparatus according to FIG. 5.
Figure 6A:
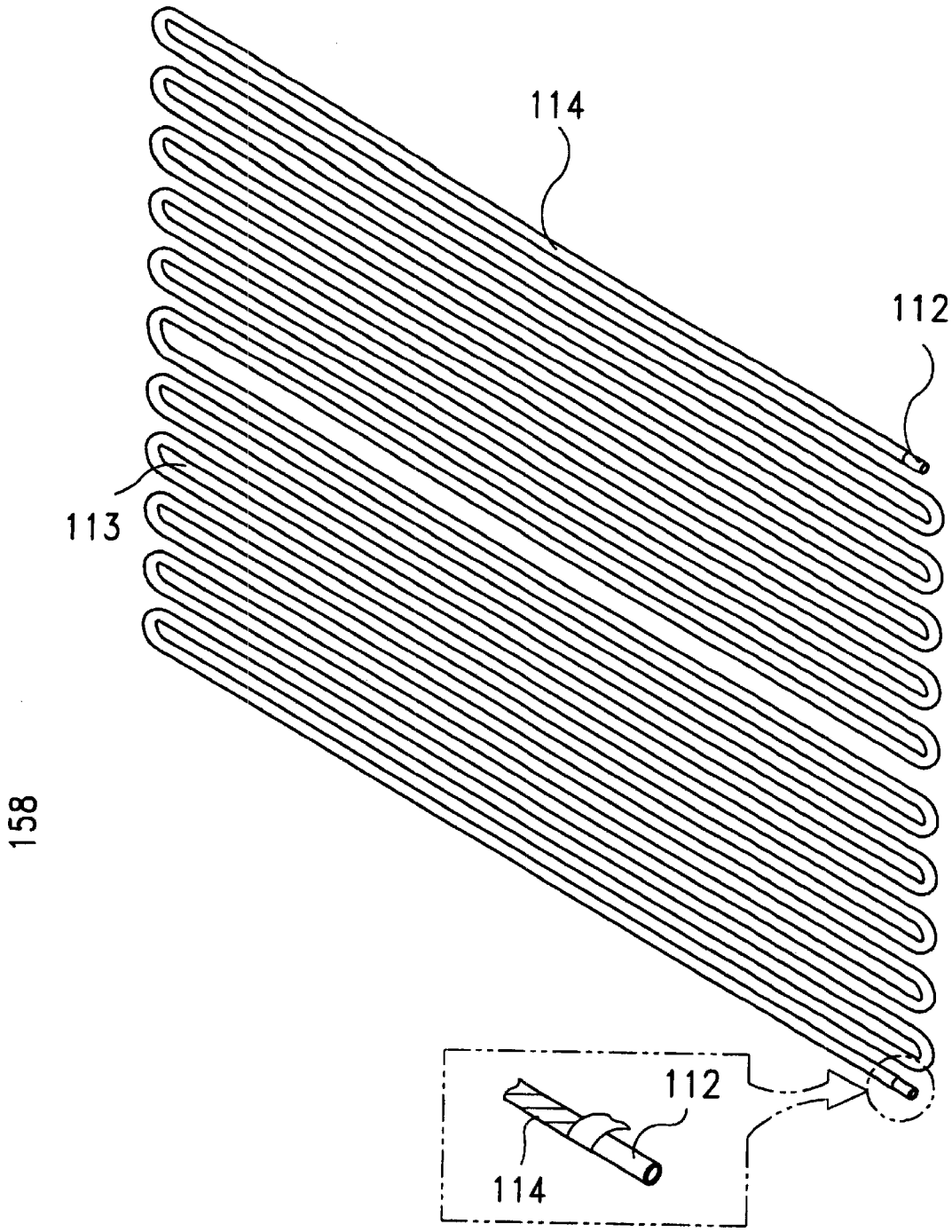
FIG. 6A shows an embodiment of a method for covering a layer of absorptive material onto a condensing coil.
Figure 6B:
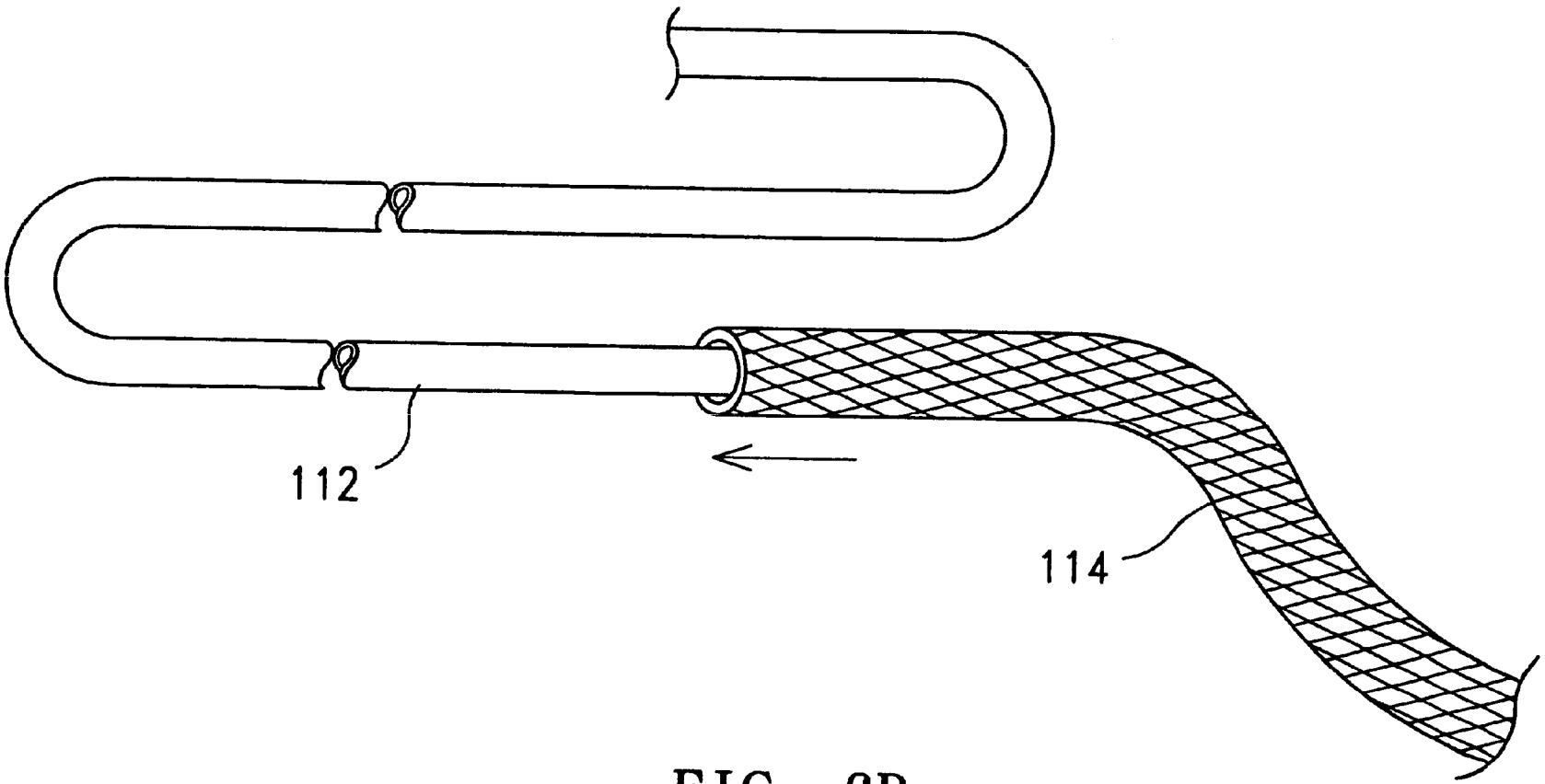
FIG. 6B shows another method for covering a layer of absorptive material onto a condensing coil.

Referring to FIG. 6, 6A and 6B, there shows different methods for covering the absorptive material 114 onto the condensing coils 112 which FIG. 6A shows a tape of absorptive material 114 spirally wound onto coil 112, while FIG. 6B shows a tubular absorptive material 114 slipped freely over the coil 112 thereon, the absorptive material 114 can be obtained from non-woven cloth, cloth, natural fibers, synthetic fibers, etc.

Figure 7:
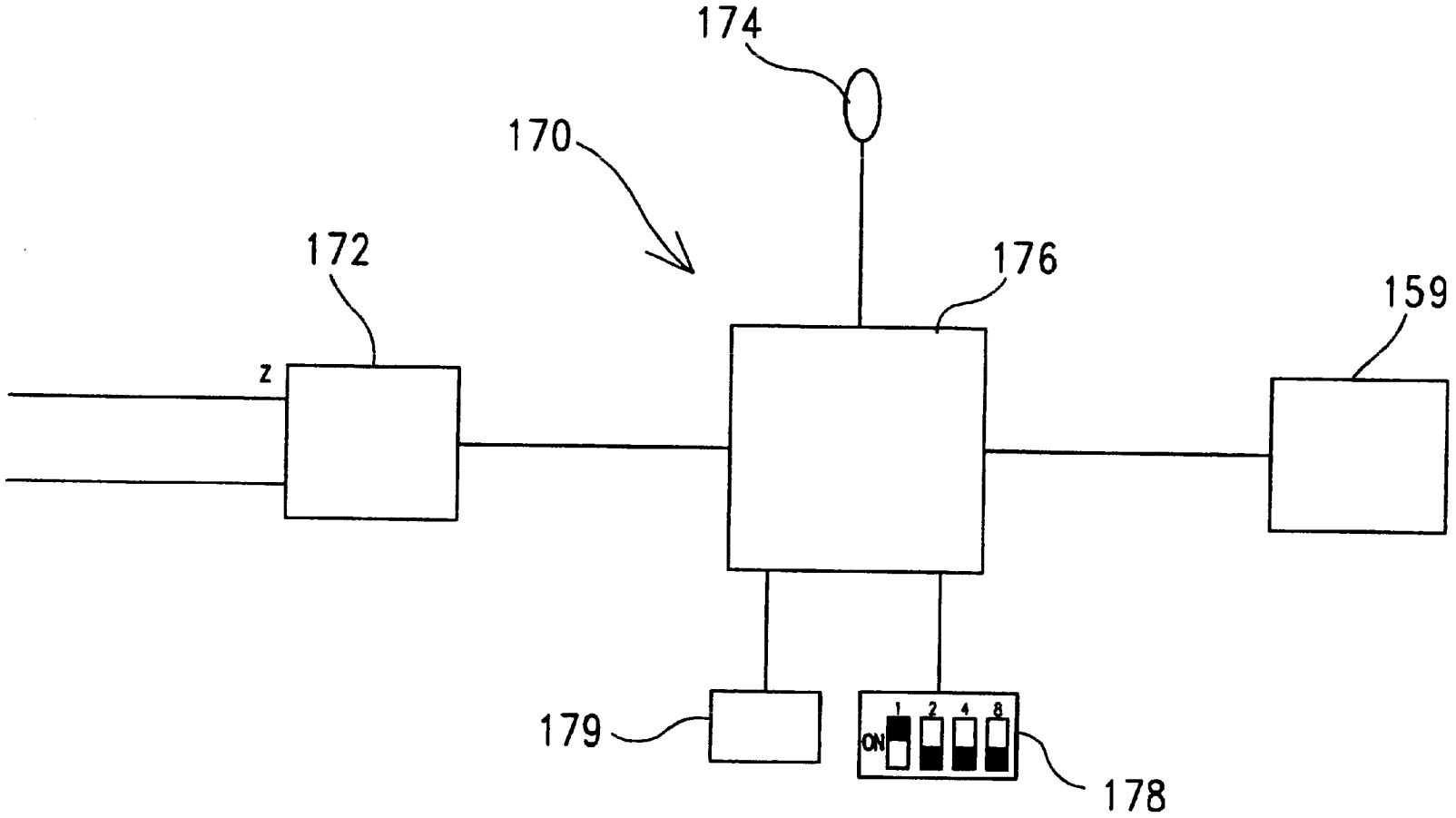
FIG. 7 is a block diagram of a PC board according to the present invention.
Figure 7A:
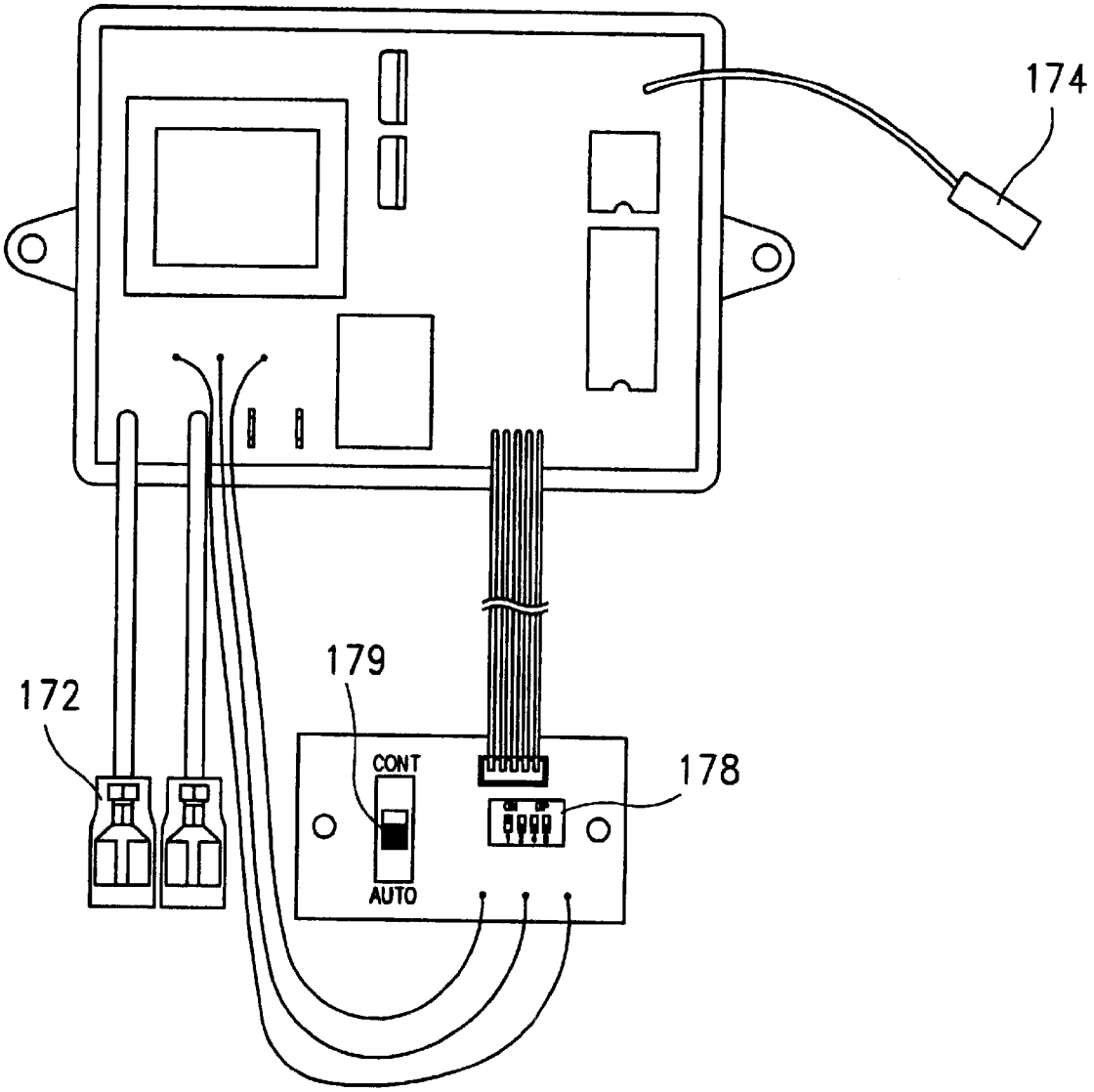
FIG. 7A is a plan view of FIG. 7.
Figure 8:
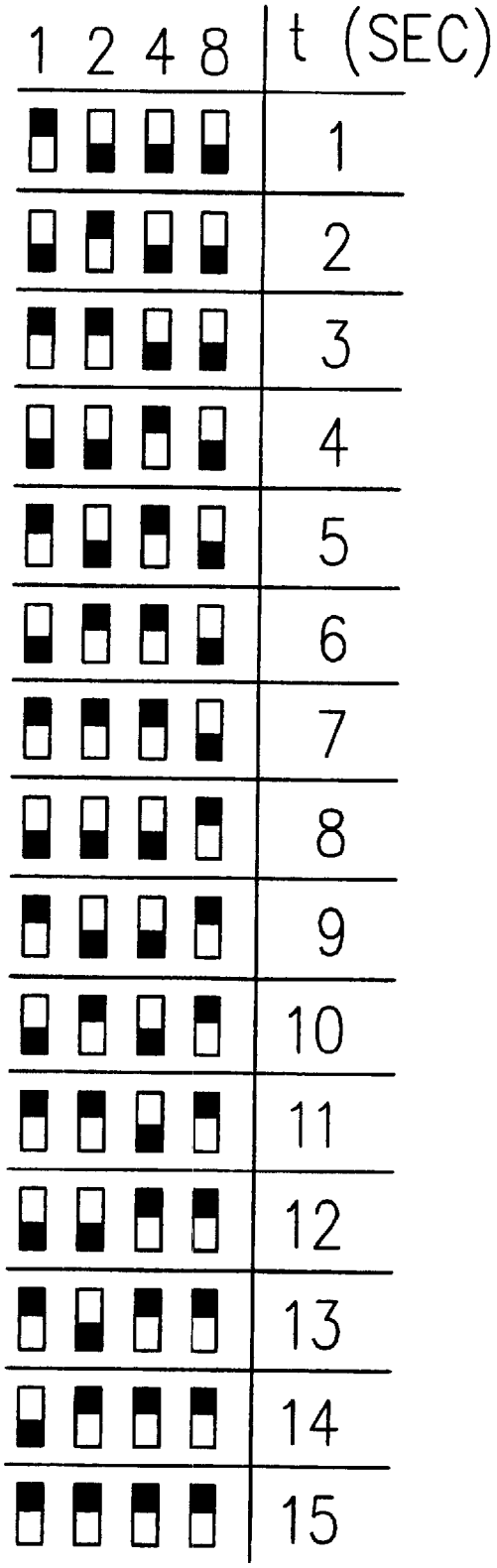
FIG. 8 shows how to set a periodic time of water supplying from 1 sec. to 15 sec. by a piano switch shown in FIG. 7.

Referring to FIG. 7 and 7A, a PC board 170 which automatically control the evaporative water supply system 150 comprises a CPU 176, a power supply connector 172, a piano switch 178 disposed on the front panel 101 for manually setting a predetermined time period of evaporative water supplying from 1 second to 15 seconds (se FIG. 8) according to the capacity of the air conditioner referred to the instruction of the manufacturer, a select switch 179 having an "auto" position for normal operation and a "cont." (continuous) position for cleaning the apparatus only during maintenance, a thermal sensor 174 for detecting the medium temperature in the condensing coil 112, and an output line to automatically control the open/close operation of the electromagnetic valve 159.

Figure 9A:
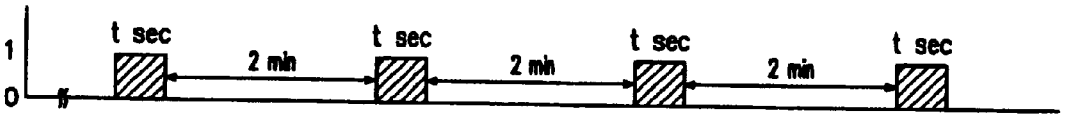
FIG. 9A is a schematic drawing showing a set period of water supplying and a predetermined intermittence of a normal operating status controlled by the PC board.
Figure 9B:
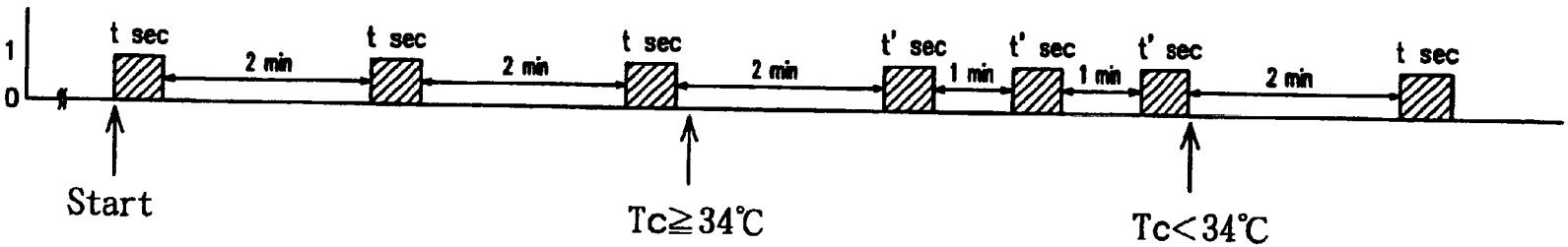
FIG. 9B showing a schematic diagram which the period of water supplying and the intermittence are adjusted by the PC board automatically due to an excess temperature occurs.
Figure 15:
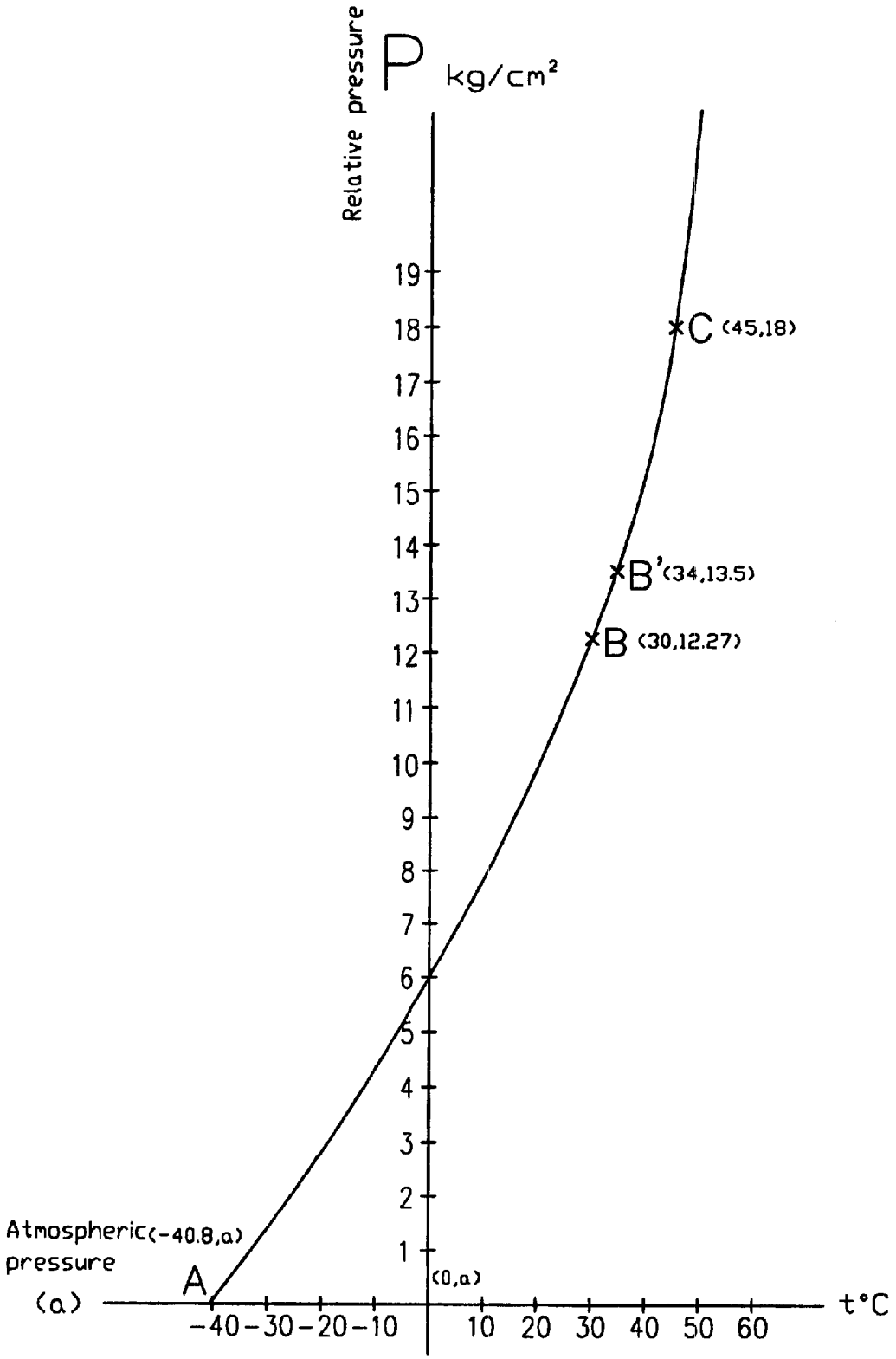
FIG. 15 is a schematic diagram showing a liquid-gas curve obtained from R-22 cooling medium.

Referring to FIG. 9A and 9B with FIG. 7 and 7A, when in normal operation after a proper water supplying time of "t" sec. being set by the piano switch 178, and the select switch 179 being selected at the "auto" position, the CPU 176 of the PC board 170 will automatically operates the electromagnetic valve 159 to open for "t" sec. once alternatively after a predetermined regular intermittence, say two minutes for instance as shown in FIG. 9A In which the intermittent time of two minutes is assumed that the amount of water once supplied to the absorptive material 114 covered on the condensing coils 112 in a "t" second period will be approximately fully evaporated within the controlled intermittence to provide a highest effect for absorbing latent heat from the cooling medium for obtaining an ideal setting temperature around 34° C. (point B' in FIG. 15). In case of a temperature signal fed back from the thermal sensor 174 is exceeded 34° C. as show in FIG. 9B the CPU 176 will automatically reduce the intermittence to a predetermined substitution say one minute for example, and automatically override the manual setting of the piano switch 178 to increase the water supplying period of "t" sec. to a preferable period of "t" sec., until when the temperature is dropped back to the ideal setting of 34° C., the intermittence and the water supplying period will be automatically reset to the original by the CPU 176 so as to maintain a constant temperature of 34° C. therefore.

It is clear that the main characterization of the present invention is not to only by using of absorptive material 114 covered on the condensing coils 112 but also by using an intermittent water supplying system 150 to let the water (which is held in the absorptive material) having enough time to fully evaporated, and automatically controlled by a PC board 170 to maintain an extreme low constant temperature for highly increasing the cooling efficiency of the evaporative condensing apparatus therefore.

Figure 10:
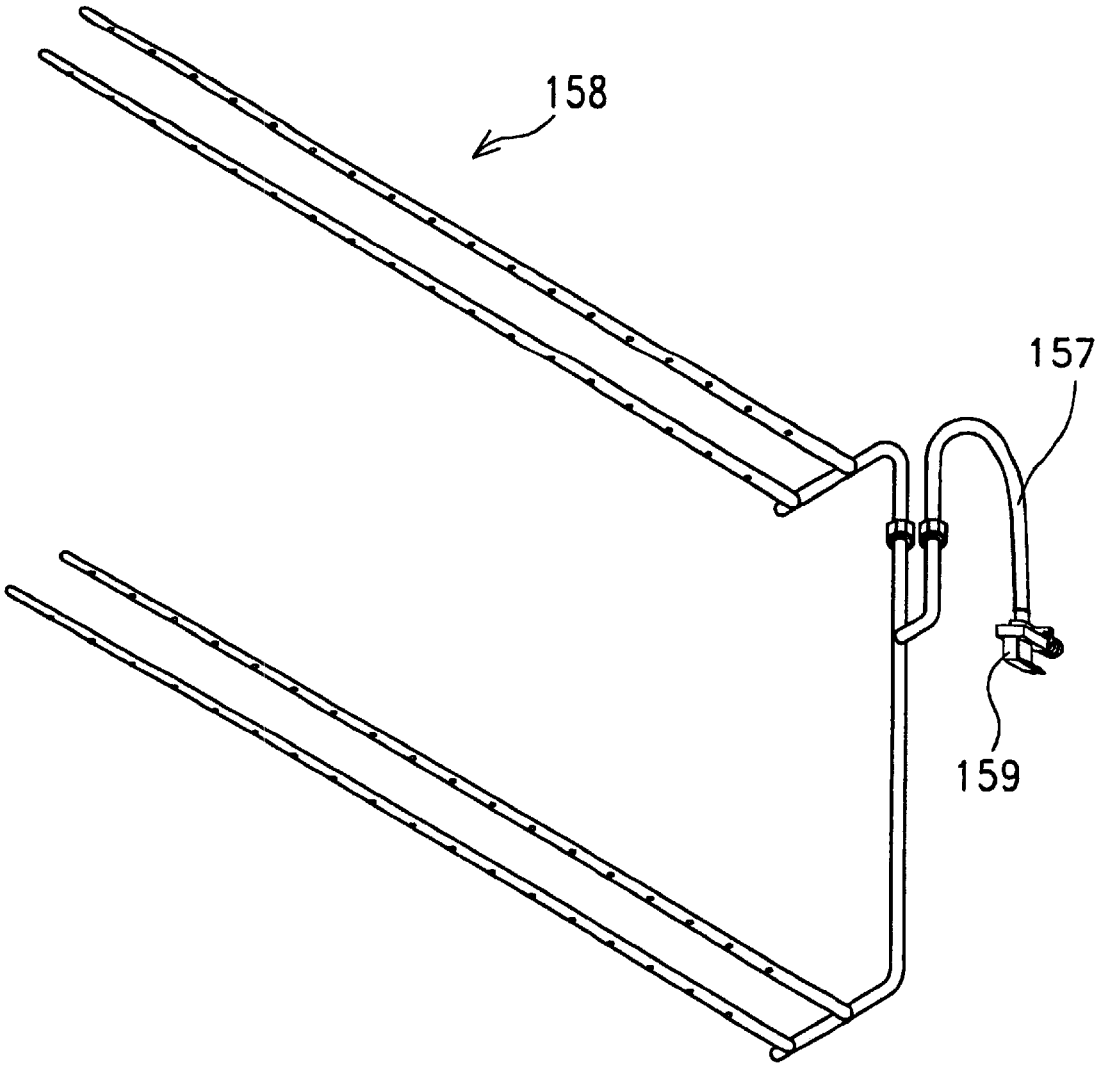
FIG. 10 shows an embodiment of a water distributor used in the evaporative condensing apparatus of the present invention.
Figure 11:
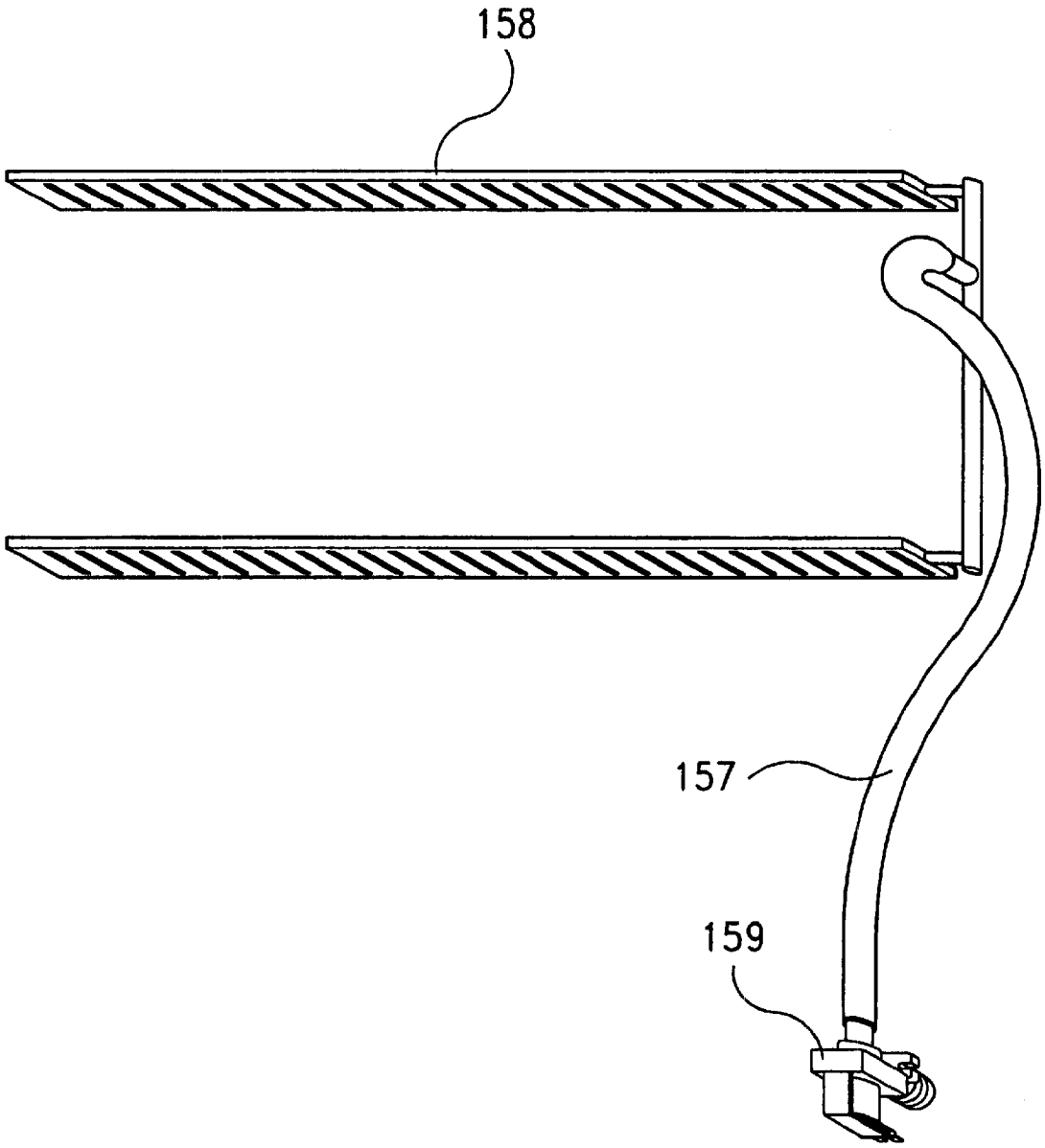
FIG. 11 shows another embodiment of a water distributor of FIG. 10.
Figure 12:
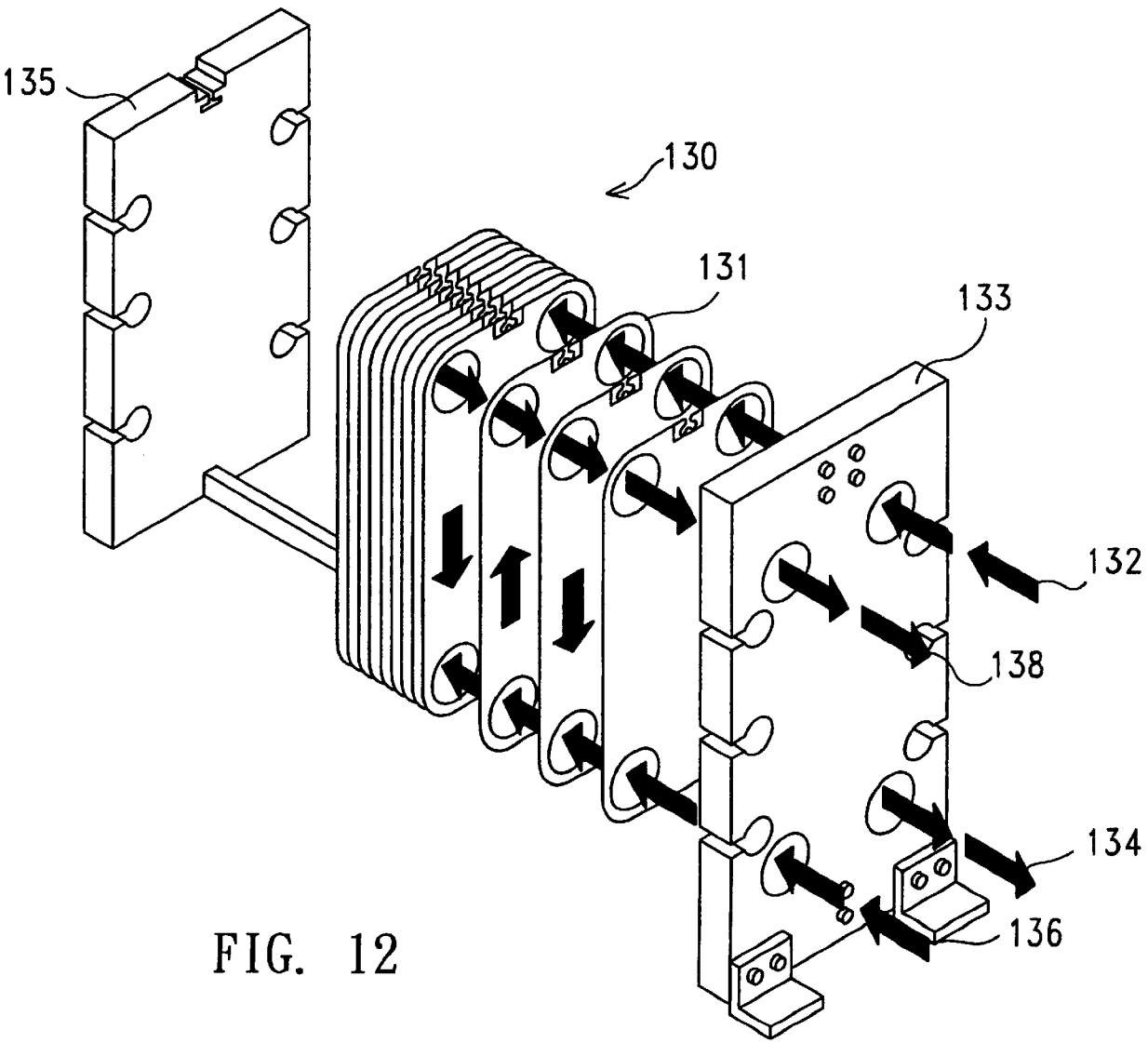
FIG. 12 is perspective view of a preferable embodiment of a heat exchanger used as an evaporating apparatus in the outdoor unit of the present invention.

Referring to FIG. 10 and FIG. 11, a water distributor 158 can be formed of different types, which FIG. 10 shows water distributors 158 formed of a plurality of round manifold tubes having a plurality of spray holes disposed downward and evenly to each manifold tubes, a hose 157 for guiding evaporative water to the distributor 158 intermittently from the electromagnetic valve 179 therefrom, while FIG. 11 shows a plurality of flat manifold tubes of distributors 158 instead of round manifold tubes thereof Referring to FIG. 12, a sandwich plate type medium/water heat exchanger used as a water chiller of the evaporating apparatus 130 in the present invention which comprises a plurality layers of heat conductive metal plates 131 formed a plurality of thin medium compartments and a plurality of thin water compartments arranged alternately one after another separated respectively by heat conductive metal plates 131 and fixed by a rear wall 135 and a front wall 133, a medium inlet 132, a medium outlet 134, a water inlet 136 and a water outlet 138 with pipe fitings (not shown) disposed at the front wall 133 to connect with the respective corresponding piping system therefore, in which the cooling medium takes evaporative latent heat from water so as to produce chilled water threat.

Figure 13:
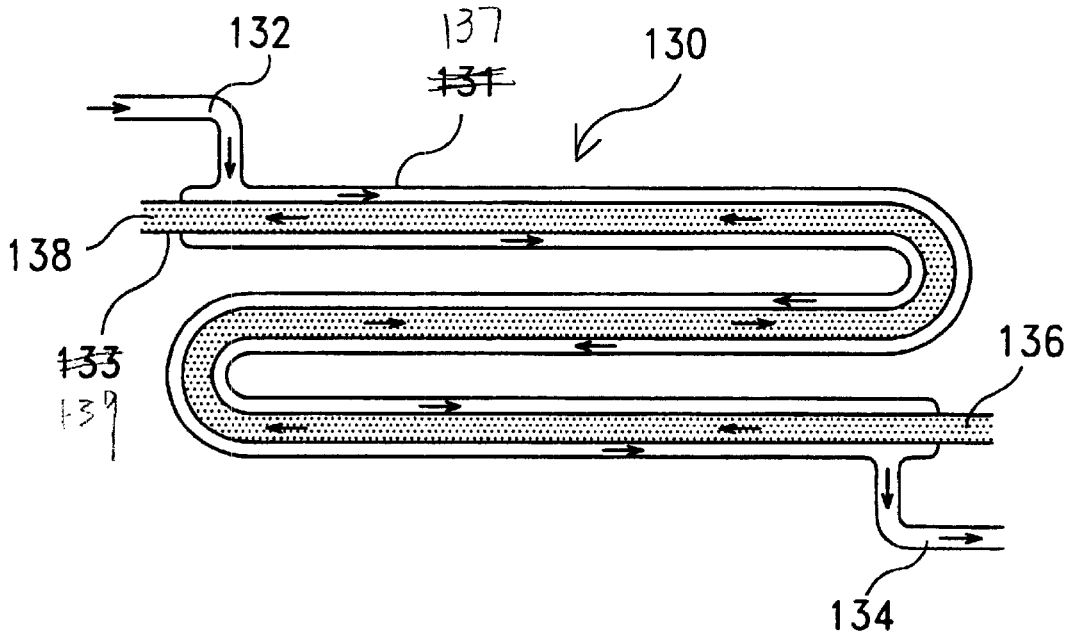
FIG. 13 shows an alternative embodiment of a sleeve tubular coil type heat exchanger.
Figure 14:
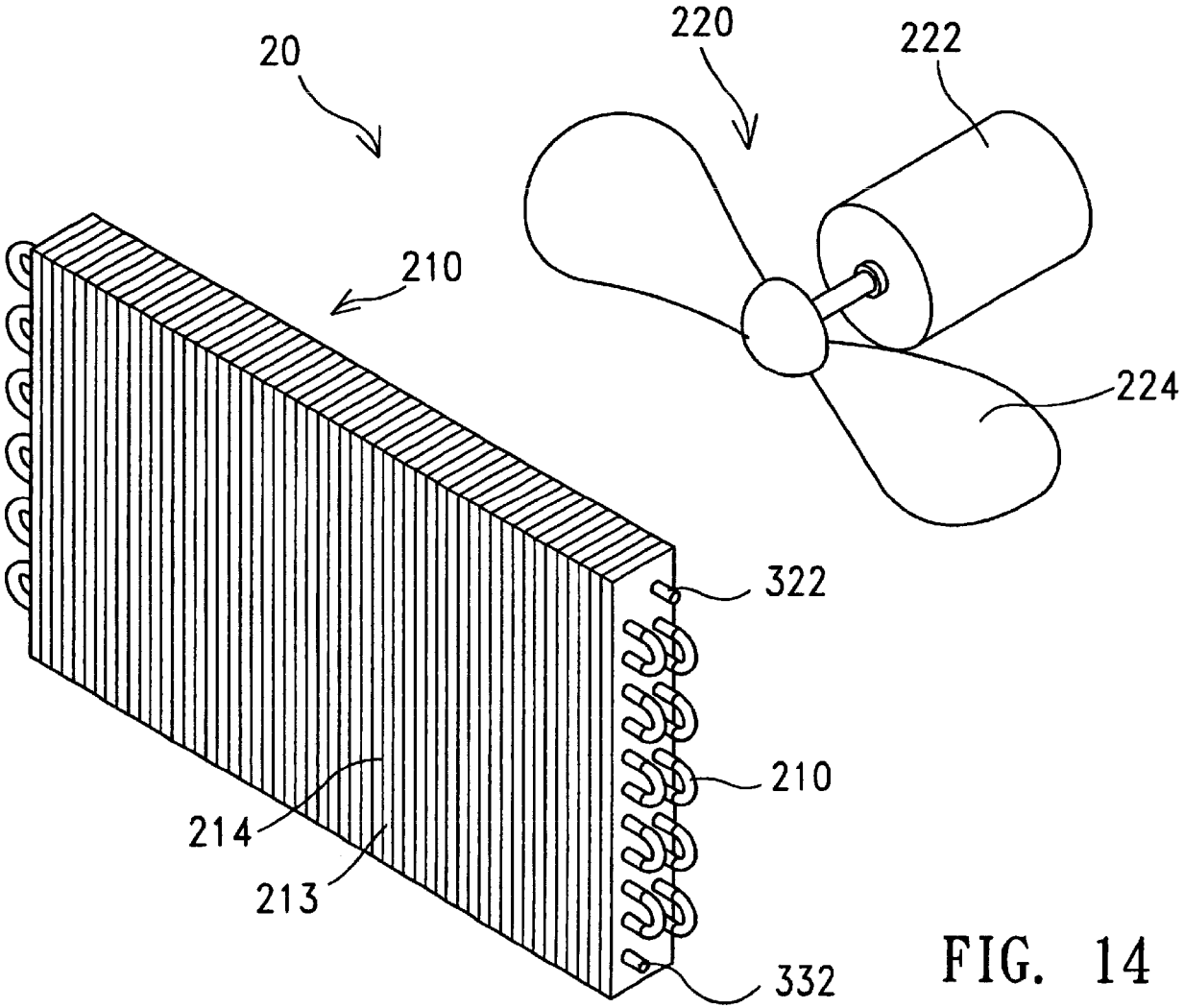
FIG. 14 is an exploded view of a preferable embodiment of an indoor unit of the present invention.

Referring to FIG. 13, an alternative heat exchanger 130 of a sleeve tubular coil type having a water circulation core tube 139 inserted in the coil tube 137 in which the cooling medium guided from the inlet 132 into a tubular space between the core tube 139 and coil 137 and evaporated thereat to chill the circulating water therein, and then guided to the compressor 122 (not show) from an outlet 134, the circulating water passed through the core tube 139 in a reversed direction of the medium flow from an inlet 136 to an outlet 168 thereof Referring to FIG. 14, an outdoor unit 20 comprises a water/air heat exchanger 210 having a plurality of chilled water coils 212 and a plurality of cooling fins 214 formed a plurality of air gaps 213 thereat, and a fan system 220 having a motor 222 and a fan blade 224 to circulate an air flow through the gaps 213 for cooling the air flow in the room to be cooled, a remote switch (not shown) can be used to control the speed (RPM) of the fan motor 222 for maintaining a predetermined ideal room temperature therefore.

It is to be understood that the drawings are designed for purposes of illustration only, and are not intended as a definition of the limits and scope of the invention disclosed.

What is claimed is:

1. A separated type air conditioner with evaporative condensing apparatus comprises:

an outdoor unit, at least one indoor unit, and a chilled water circulation piping system connected between said outdoor unit and each of said indoor unit for cooling capability transmission;

which said outdoor unit comprises:

an evaporative condensing apparatus including a plurality of medium condensing coils formed a plurality of air gaps thereat, a layer of absorptive material covered over all heat conductive surfaces of said condensing coil thereon, an evaporative water supply system having a plurality of water distributors and an electromagnetic valve for intermittently spraying water to said absorptive material hereon, a fan system to draw currents of air passing through said air gaps between said condensing coils for speeding the rate of evaporating of absorbed water in said absorptive material and carrying the evaporated moisture and heat away from said evaporative condensing apparatus, a PC board automatically controlling an open/close operation of said electromagnetic valve therefore; an evaporating apparatus formed of a medium/water heat exchanger type water chiller in which a water flow is chilled due to cooling medium evaporating and be transmitted to each of said indoor unit for using as a cooling source therefore; and a cooling medium circulating system including a medium compressor for compressing gas state cooling medium into said evaporative condensing apparatus to condense cooling medium into liquid state, a liquid medium piping for guiding condensed medium from said evaporative condensing apparatus to said evaporating apparatus, an expansion valve disposed at a medium inlet of said evaporating apparatus for evaporating liquid state cooling medium into gas state in said evaporating apparatus to produce chilled water thereat, a gas medium piping for guiding evaporated medium back to said compressor from said evaporating apparatus so as to complete a medium circulating system therefore;

while each of said indoor unit is formed of a water/air heat exchanger to cool air currents by chilled water delivered from said water chiller type evaporating apparatus of said outdoor unit, in which the room temperature will be dropped by cooled air currents therefore;

and said chilled water circulating system circulated between said water chiller type evaporating apparatus of said outdoor unit and said heat exchanger type indoor unit compressing a water pump disposed in said outdoor unit, a chilled water delivering piping with pipe fittings for delivering chilled water to each of said indoor unit from said water chiller of said outdoor unit, and a water feedback piping with pipe fittings for guiding heated water back to said water pump after heat exchanging in said indoor unit so as to complete a water circulating system therefore.

2. The separated type air conditioner of claim 1 wherein said water chiller type evaporating apparatus is a sandwich plate type heat exchanger comprising a plurality of heat conductive metal plates formed a plurality of thin medium compartments and a plurality of thin water compartments arranged alternately one to another and fixed by a front wall and a rear wall, a medium inlet, a medium outlet, a water inlet and a water outlet with pipe fittings disposed at said front wall to connect respectively with said medium piping system and said water piping system for chilling a flow of circulated water by the evaporating of cooling medium therefore.

3. The separated type air conditioner of claim 1 wherein said water chiller type evaporating apparatus is a sleeve tubular coil type heat exchanger comprising a core coil tube inserted in a larger sleeve coil formed a tubular hollow space for guiding liquid state medium to evaporate thereat, a flow of circulating water been guided into said core coil tube in a direction reversed to the direction of medium for gradually chilling circulating water therefore.

4. The separated type air conditioner of claim 1 wherein each of said indoor unit is formed of a water/air heat exchanger comprising a plurality of chilled water coils and a plurality of cooling fins to provide a plurality of air gaps between said water coils and said cooling fins, a fan system for drawing air currents passing through said air gaps and to be cooled therein, a remote control switch for selecting a predetermined speed stage (RPM) of said fan system to obtain a ideal comfortable room temperature of air condition therefore.

5. The separated type air conditioner of claim 1 wherein said absorptive material covered on said condensing coils of said evaporative condensing apparatus is made of loose and soft fibers such as non-woven cloth, natural fiber cloth, synthetic fiber cloth etc.

6. The separated type air conditioner of claim 2 wherein said absorptive material is formed of a tubular hose slipped onto said condensing coils of evaporative condensing apparatus.

7. The separated type air conditioner of claim 2 wherein said absorptive material is formed of a tap spirally wound onto said condensing coil of said evaporative condensing apparatus.

8. The separated type air conditioner of claim 1 wherein said evaporative water supply system has a stand by water source been used when a normal water source of city water system is accidentally out of supplying, including a water tank for collecting condensed water produced on a surface of said water chiller type evaporating apparatus and also collecting condensed water from said water/air heat exchanger type indoor unit by a collected water delivering pipe from said indoor unit to said water tank of said outdoor unit, a water pump for pumping water to said evaporative water distributor through said electromagnetic valve.

9. The separated type air conditioner of claim 1 wherein said PC board comprises a piano switch for setting a period of time for water supplying from 1 second to 15 seconds, a select switch having an "auto" position for normal operation and a "cont."(continuous) position only used to clean said condensing unit for maintenance, a thermal sensor for detecting the temperature of cooling medium in said condensing coils, and a CPU unit for processing to select a predetermined regular intermittence or a reduced substitutional intermittence of said intermittent water supply system by control said electromagnetic valve automatically according to a temperature signal fed back from said thermal sensor in compare with a setting temperature.

* * * * *